US009797214B2

(12) United States Patent
Gadre et al.

(10) Patent No.: US 9,797,214 B2
(45) Date of Patent: Oct. 24, 2017

(54) CASING HANGER SHOULDER RING FOR LOCK RING SUPPORT

(71) Applicant: Vetco Gray Inc., Houston, TX (US)

(72) Inventors: Aniruddha D. Gadre, Houston, TX (US); Mayur Mansukh, Houston, TX (US); David Lawrence Ford, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 293 days.

(21) Appl. No.: 14/551,263

(22) Filed: Nov. 24, 2014

(65) Prior Publication Data

US 2016/0145960 A1 May 26, 2016

(51) Int. Cl.

| | |
|---|---|
| ***E21B 33/03*** | (2006.01) |
| ***E21B 33/04*** | (2006.01) |
| ***E21B 33/035*** | (2006.01) |
| ***E21B 33/043*** | (2006.01) |

(52) U.S. Cl.

CPC ..... *E21B 33/03* (2013.01); *E21B 33/035* (2013.01); *E21B 33/04* (2013.01); *E21B 33/043* (2013.01)

(58) Field of Classification Search

CPC .. E21B 33/0415; E21B 33/043; E21B 33/035; E21B 33/04; E21B 33/03

See application file for complete search history.

(56) References Cited

U.S. PATENT DOCUMENTS

| | | | |
|---|---|---|---|
| 5,067,734 | A | 11/1991 | Boehm, Jr. |
| 5,813,470 | A | 9/1998 | Radi |
| 8,245,776 | B2 | 8/2012 | Gette et al. |
| 8,561,995 | B2 | 10/2013 | Thomson |
| 8,622,142 | B2 | 1/2014 | Shaw |
| 8,631,878 | B2 | 1/2014 | Duong |
| 8,636,072 | B2 | 1/2014 | Gette et al. |
| 8,851,183 | B2 | 10/2014 | Yates et al. |

(Continued)

FOREIGN PATENT DOCUMENTS

| | | | |
|---|---|---|---|
| GB | 2491712 | A | 12/2012 |

OTHER PUBLICATIONS

PCT Search Report and Written Opinion issued in connection with corresponding PCT Application No. PCT/US2015/058577 on Apr. 22, 2016.

*Primary Examiner* — Brad Harcourt
(74) *Attorney, Agent, or Firm* — Hogan Lovells US LLP

(57) ABSTRACT

A wellhead assembly has a casing hanger for supporting a string of casing, the casing hanger having an external upward-facing shoulder. A shoulder ring is mounted on the shoulder. A radially movable annular lockdown member is carried on the shoulder ring for movement between a refracted position while the casing hanger is being run and an expanded position for engaging an interior surface of a wellhead housing. A casing hanger seal is carried by the casing hanger above the lockdown member. The casing hanger seal has a nose on a lower end that engages and moves the lockdown member to the expanded position while the casing hanger seal is being lowered into a set position. The shoulder ring is formed of a material of greater yield strength than the shoulder. Flow channels between the shoulder and the shoulder ring assist in flowing debris from above the shoulder to below.

19 Claims, 3 Drawing Sheets

(56) References Cited

U.S. PATENT DOCUMENTS

| | | | | |
|---|---|---|---|---|
| 2010/0147533 | A1* | 6/2010 | Nelson | E21B 33/04<br>166/379 |
| 2011/0316236 | A1 | 12/2011 | Gette et al. | |
| 2013/0146306 | A1 | 6/2013 | Yates et al. | |
| 2014/0131054 | A1 | 5/2014 | Raynal et al. | |
| 2014/0144650 | A1 | 5/2014 | Yates et al. | |
| 2014/0183824 | A1 | 7/2014 | Benson et al. | |
| 2014/0311753 | A1 | 10/2014 | Hanson et al. | |

* cited by examiner

CASING HANGER SHOULDER RING FOR LOCK RING SUPPORT

BACKGROUND

1. Field of Invention

This invention relates in general to subsea wellheads for use in oil and gas wells, and in particular to a shoulder ring that fits on a casing hanger to provide support for a lockdown ring.

2. Description of Prior Art

A subsea well that is capable of producing oil gas typically has an outer or conductor housing secured to a string of conductor pipe which extends some short depth into the well. An inner or high pressure wellhead housing lands in the conductor housing and secures to an outer or first string of casing, which extends coaxially through the conductor to a deeper depth into the well. Depending on the particular conditions of the geological strata above the target zone (typically, either an oil or gas producing zone or a fluid injection zone), one or more additional casing strings will generally extend through the outer string of casing to increasing depths in the well until the well is cased to the final depth. Each string of casing is supported at the upper end by a casing hanger, which usually lands in and is supported by the wellhead housing.

Where multiple casing hangers are landed in the wellhead housing, they are generally stacked on one another in the wellhead housing. The lowest string of casing extends into the well to the final depth, this being the production casing. The strings of casing between the outer casing and the production casing are usually referred to as intermediate casing strings.

Between each casing hanger and the wellhead housing, a casing hanger packoff or annular seal assembly is set to isolate each annular space between strings of casing. The weight of the casing hanger and the casing hanging from the casing hanger can prevent upward movement of the casing hanger under some circumstances. A lockdown mechanism, however, is required to lock the casing hanger in place and can be used to lock the annular seal assembly to the wellhead housing when the casing hanger is subjected to high pressures. Those high pressures can cause the casing hanger to move axially upward. Expansion and contraction of the casing can also cause the annular seal to be compromised and cause leaking.

The lockdown mechanism can be a separate assembly lowered onto the upper casing hanger and locked to the wellhead housing. The lockdown mechanism can alternately comprise a lockdown ring carried by the casing hanger and moved radially to engage a profile in the wellhead housing. The radial movement may be in response to setting of the casing hanger seal. Engaging surfaces mate to resist the lockdown forces. In some current designs, the capacity of the lockdown ring is limited by the yield strength of the material used to form the casing hanger and the wellhead housing. Also, debris can clog the area and inhibit movement of the lockdown mechanism to the expanded position.

SUMMARY OF THE DISCLOSURE

The wellhead assembly of this disclosure includes a casing hanger for supporting a string of casing. The casing hanger has an external upward-facing shoulder. An annular support member is located on the shoulder, the support member being formed of a material of higher yield strength than a yield strength of the shoulder. A radially movable annular lockdown member is carried on the support member for movement between a retracted position while the casing hanger is being run and an expanded position for engaging an interior surface of a wellhead housing. A casing hanger seal is carried by the casing hanger above the lockdown member. The casing hanger seal has a nose on a lower end that engages and moves the lockdown member to the expanded position while the casing hanger seal is being lowered into a set position.

The support member may comprise a shoulder ring or a layer of metal bonded to the shoulder. If a shoulder ring is employed, it may be secured to the casing hanger with fasteners or other means.

Flow channels may be formed in and extend from an inner diameter of the shoulder ring to an outer diameter of the shoulder ring to assist in removing debris that may collect on the shoulder ring. The flow channels have inlets on an upper side of the shoulder ring and outlets on a lower side of the shoulder ring. The outlets are radially outward from the inlets relative to a longitudinal axis of the casing hanger.

The shoulder ring may have an upper side that is slidingly engaged by a lower side of the lockdown member while the lockdown member moves from the retracted to the expanded position. The upper side may be within a plane perpendicular to a longitudinal axis of the casing hanger. In the preferred embodiment, the shoulder on the casing hanger is conical. The shoulder ring has a lower side that is conical and mates with the shoulder.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
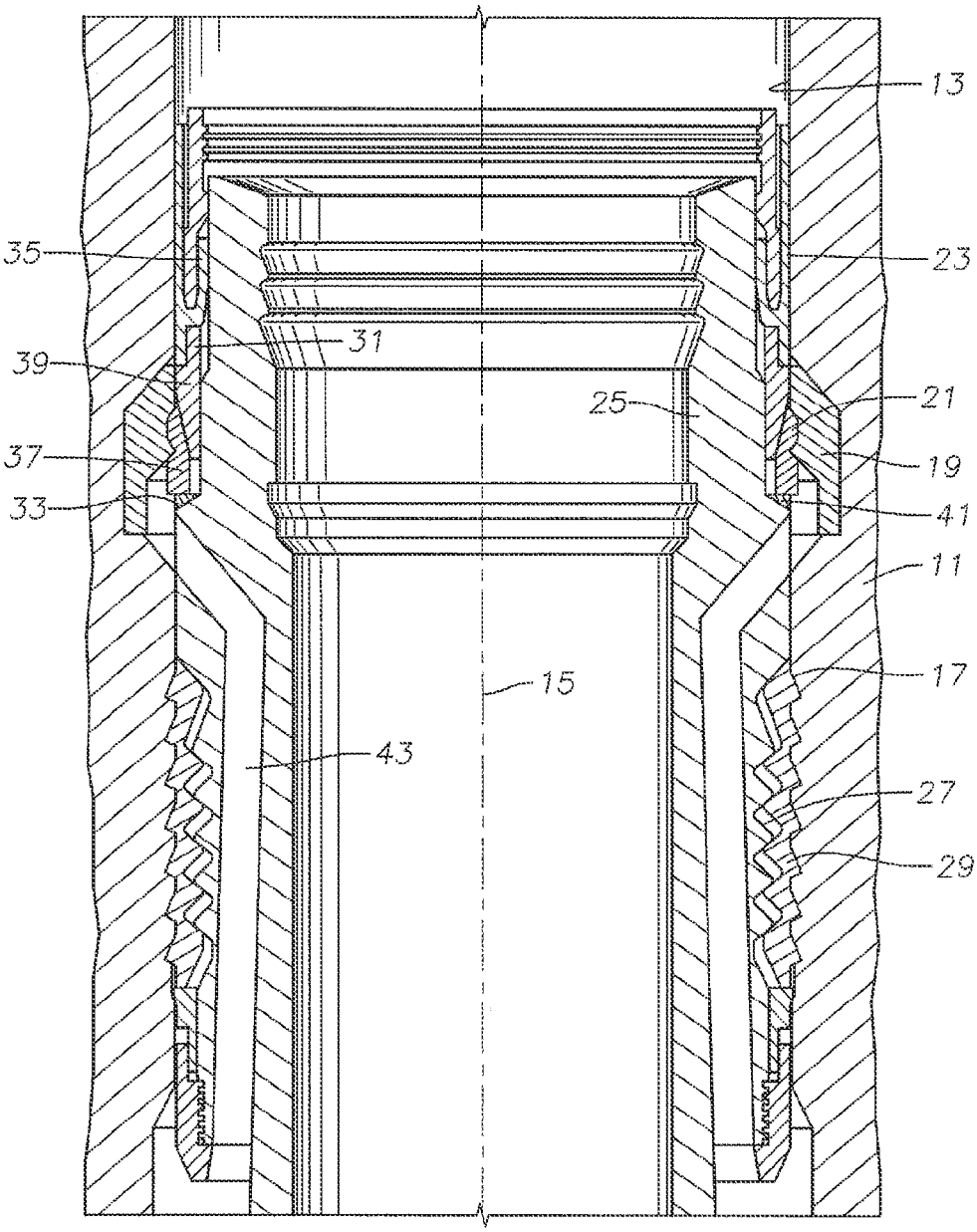
FIG. 1 is a sectional view of a wellhead assembly with a casing hanger having a shoulder ring in accordance with an embodiment of this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. The terms "vertical", "horizontal", "upward", "downward", "above", and "below" and similar spatial relation terminology are used herein only for convenience because elements of the current disclosure may be installed in various relative positions.

Referring to FIG. 1, a wellhead assembly includes a tubular wellhead member, such as wellhead housing 11, with a central bore 13 having a longitudinal axis 15. Wellhead housing 11 is a high pressure tubular member typically located subsea over a well (not shown). Wellhead housing 11 is normally located in the bore of an outer or low pressure wellhead housing (not shown). Wellhead housing 11 secures to a first string of casing (not shown), which extends through a conductor pipe to a depth into the well.

Wellhead housing 11 has a load shoulder 17 in its bore, which may comprise several, as shown, or only one. A lockdown profile member or ring 19 is located in an annular recess in bore 13 above load shoulders 17. Lockdown profile ring 19 may be made up several arcuate segments inserted into and secured in the annular recess. Lockdown profile ring 19 has a lockdown profile 21 in its inner diameter. Bore 13 optionally has wickers 23 located above lockdown profile ring 19, the wickers comprising parallel annular sawtooth grooves.

A casing hanger 25 lands in bore 13. Casing hanger 25 secures to a string of casing (not shown) extending into the well. Casing hanger 25 has at least one, and in this example several load shoulders 27 on its lower exterior surface. A radially expansible load ring 29 has inner teeth flanks that engage casing hanger load shoulders 27 and outer teeth flanks that engage wellhead housing load shoulders 17 to support the weight of casing hanger 25 and the string of casing. Load ring 29 may be a collet type ring that allows its radial expansion and contraction.

Casing hanger 25 has a cylindrical upper exterior portion 31 that is spaced inward a selected distance from the side wall of bore 13 to define a seal pocket. Casing hanger 25 has an upward facing exterior lockdown shoulder 33 at the lower end of upper exterior portion 31.

A casing hanger seal or packoff assembly 35 locates in the seal pocket, and when set, firms a sealing engagement with wickers 23 and upper exterior portion 31. A lockdown member or ring 37 surrounds casing hanger exterior portion 31 below seal 35. Lockdown ring 37 moves radially from a retracted position, not shown, to the expanded position shown in FIG. 1. In the expanded position, lockdown ring 37 engages lockdown profile 21 to prevent upward movement of casing hanger 25 due to high pressure in the well. Lockdown ring 37 may comprise a split ring, a collet, or some other type of radially expansible annular member. Seal assembly 35 has a nose ring 39 on its lower end that engages and pushes lockdown ring 37 to the expanded position while seal assembly 35 is undergoing the setting procedure.

Lockdown ring 37 is carried on a shoulder ring 41 that is located on casing hanger upward facing lockdown shoulder 33. Shoulder ring 41 is preferably a solid member that is not radially expansible. Alternately, shoulder ring 41 could comprise an inlay or layer of metal welded or otherwise bonded to casing hanger shoulder 33. The lower end of lockdown ring 37 slides on shoulder ring 41 as lockdown ring 37 moves from its retracted to expanded position.

Preferably, shoulder ring 41 is formed of a higher strength material than the body of casing hanger 25, which includes lockdown shoulder 33. The material of shoulder ring 41 is also higher in strength than the material of wellhead housing 11. Typical yield strengths for the body of casing hanger 25 and wellhead housing 11 would be about 80,000 psi. The yield strength of the material of shoulder ring 41 is preferably in the range from 120,000 to 140,000 psi. The higher strength material increases the strength of casing hanger lockdown shoulder 33 to resist lockdown load. Optionally, the high strength material could be more resistant to sour gas applications. One type of suitable material is 120,000 psi yield Inconel. The higher strength material may also be utilized for lockdown profile member 19 and lockdown ring 37.

Figure 2:
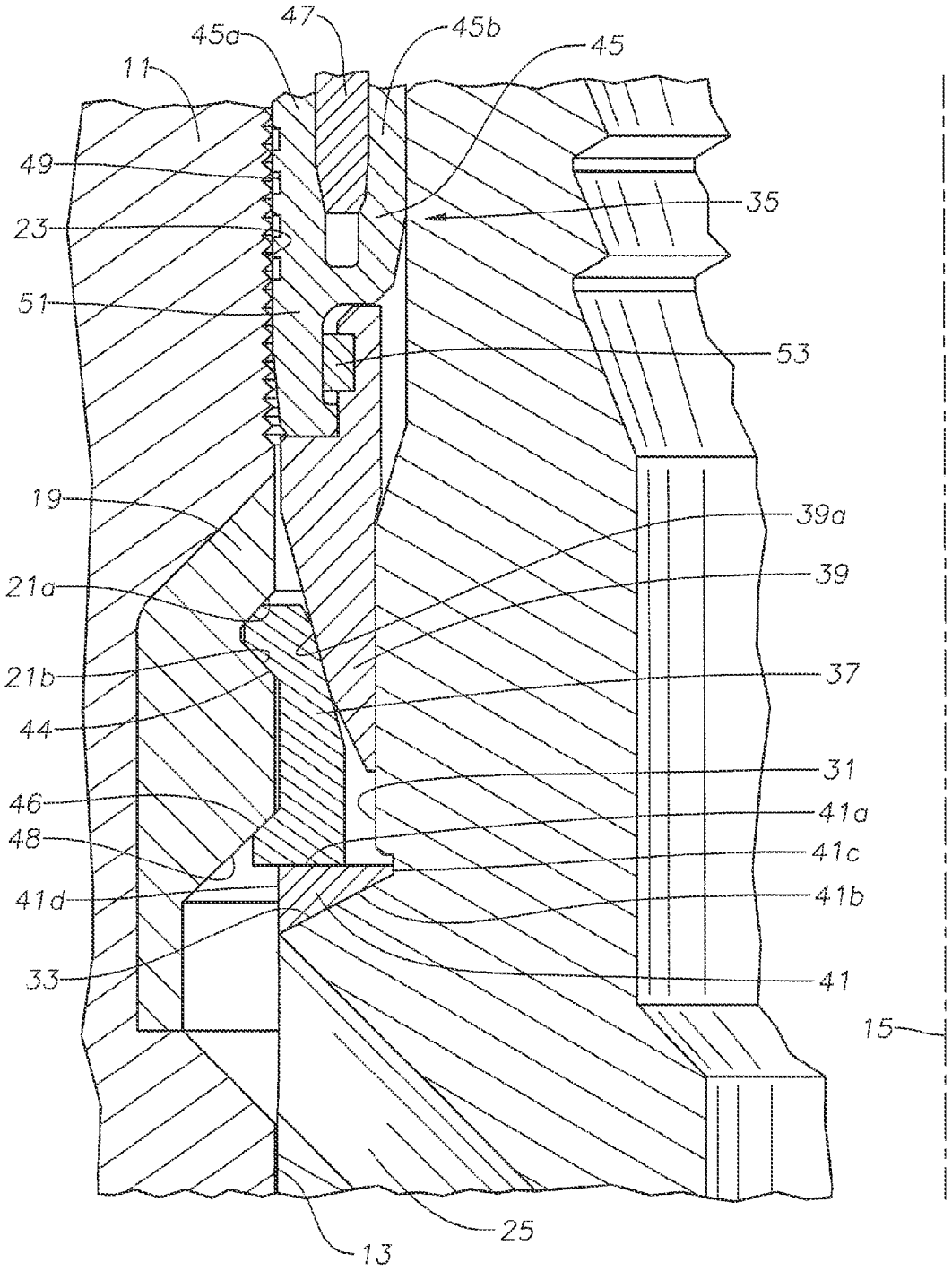
FIG. 2 is an enlarged sectional view of a portion of the casing hanger and shoulder ring of FIG. 1.

Referring to FIG. 2, shoulder ring 41 may be generally triangular when viewed in cross-section. Preferably, an upper side 41*a* of shoulder 41 is flat and located in a plane perpendicular to longitudinal axis 15. A lower side 41*b* is conical and matches the conical angle or taper if casing hanger lockdown shoulder 33. The degree of the conical angle may vary, and is illustrated to be about 35 degrees. Shoulder ring 41 has an inner diameter 41*c* that is closely spaced to casing hanger upper exterior portion 31. Shoulder ring 41 has an outer diameter 41*d* that is flush with the outer diameter of casing hanger 25 immediately below casing hanger lockdown shoulder 33. Because of conical lower side 41*b*, outer diameter 41*d* will have a greater thickness or dimension than inner diameter 41*c* measured between upper side 41*a* and lower side 41*b*.

Referring still to FIG. 2, casing hanger 25 has cement returns flow by passages 43 extending from a lower end of casing hanger 25 to the exterior just below lockdown shoulder 33. Mating flow by channels (not show) may also be located in lockdown profile member 19 and lockdown ring 37.

As shown in FIG. 2, profile 21 of lockdown profile member 19 comprises an upper annular groove that may have a generally V-shaped configuration. Profile 21 comprises a downward and inward-facing surface 21*a* that joins an upward and inward facing surface 21*b* at about a 90 degree angle.

Lockdown ring 37 has on its outer side an upper rib 44 with a configuration that matches lockdown profile 21. Lockdown ring 37 has on its outer side a lower rib 46 with an upward and outward facing surface that bears against a downward and inward facing shoulder 48 on the lower end of lockdown profile member 19.

Casing hanger seal assembly 35 may have a variety of configurations. Preferably, seal assembly 35 is a metal-to-metal type of seal. In the example shown, seal assembly 35 includes a seal ring 45 that has inner and outer walls or legs 45*a*, 45*b* that are radially spaced apart from each other. During setting, an energizing ring 47 moves down the annular slot between legs 45*a*, 45*b*, wedging them radially apart from each other. Seal ring 45 optionally may have parallel annular grooves 49 on one of its seal surfaces containing a soft material, such as a metal, to enhance sealing. In the example shown, soft material inlay grooves 49 are on the outer leg 45*a* and engage wickers 23 when set.

Seal ring 45 has a lower extension 51 extending downward from outer seal leg 45*a*. Nose ring 39 couples to lower extension 51, such as with a retainer ring 53. Nose ring 39 has an outward facing cam surface 39*a* that engages an inward facing cam surface on lockdown ring 37 to push it to the expanded position. During the run-in of casing hanger 25, seal assembly 35, including nose ring 39, will be located in an upper position (not shown), which is above casing hanger upper exterior portion 31. Lockdown ring 37, however, will preferably be located on shoulder ring 41 and in a retracted position during the run-in of casing hanger 25.

Figure 3:
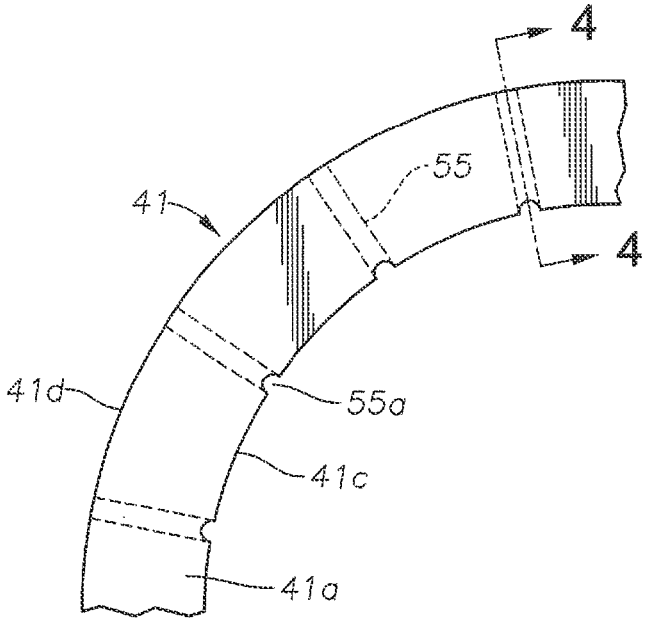
FIG. 3 is a top view of a portion of the shoulder ring of FIG. 1.
Figure 4:
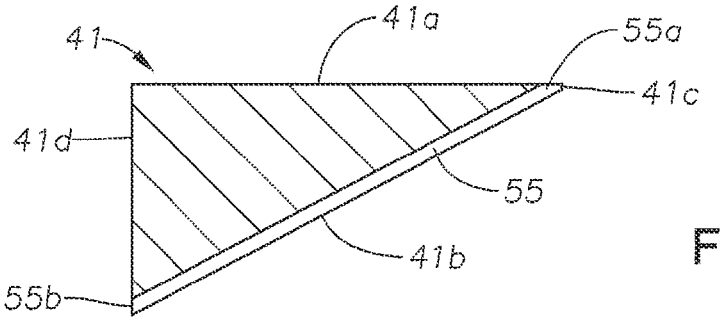
FIG. 4 is a sectional view of the shoulder ring of FIG. 1, taken along line 4-4 of FIG. 3.
Figure 5:
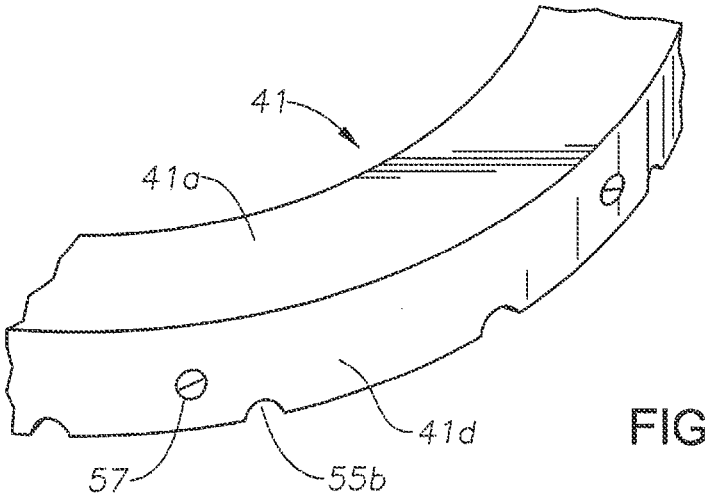
FIG. 5 is a partial perspective view of the shoulder ring of FIG. 1.

Referring to FIGS. 3-5, shoulder ring 41 optionally may have flow channels 55 to provide an escape path for debris trapped in the area below nose ring 39 (FIG. 2) and above shoulder ring 41. In this embodiment, flow channels 55 are evenly spaced around the circumference of shoulder ring 41. Each flow channel 55 extends along shoulder ring lower side 41*b* from shoulder ring inner diameter 41*c* to shoulder ring outer diameter 41*d*. Each flow channel 55 has an inlet 55*a* on upper side 41*a* and an outlet 55*b* on outer diameter 41*d* at lower side 41*b*. The lower side of each flow channel 55 is defined by casing hanger lockdown shoulder 33 (FIG. 2). Outlet 55*b* is lower and radially outward from inlet 55*a* for each flow channel 55.

Shoulder ring 41 may be secured to casing hanger lockdown shoulder 33 (FIG. 2) in a variety of manners to prevent shoulder ring 41 from lifting upward during run-in of casing hanger 25 and cementing. In the example of FIG. 5, threaded fasteners 57 extend through radial holes in shoulder ring 41. Each fastener 57 has a tip (not shown) that engages a portion on casing hanger 25, such as a mating threaded hole. Each fastener 57 has a head that is accessible from shoulder ring outer diameter 41*d*.

During operation, a technician slides shoulder ring 41 over casing hanger upper exterior portion 31 and down onto shoulder ring 41, as shown in FIG. 2. The technician tightens fasteners 57 (FIG. 5) to secure shoulder ring 41 on casing hanger lockdown shoulder 33. The technician slides lockdown ring 37 over casing hanger upper exterior portion 31 and places it on shoulder ring 41. Casing hanger 25 will be secured to the upper end of a string of casing being lowered into the well. The technician attaches seal assembly 35 to a running tool (not shown) and attaches the running tool to casing hanger 25.

Rig personnel attach the running tool to a running string and lower the assembly into a riser leading to wellhead housing 11, which may be thousands of feet below the drilling vessel. Casing hanger load ring 29 lands on and latches to wellhead housing load shoulders 17. After circulating drilling fluid, rig personnel pump cement down the running string and casing, causing returns to flow back up the annulus surrounding the casing. The returns flow up flow by passages 43 and in the annulus between casing hanger upper exterior portion 31 and wellhead housing bore 13.

After the cement has set, rig personnel actuate the running tool to lower casing hanger seal assembly 35 relative to casing hanger 25, causing nose ring 39 to engage lockdown ring 37 and push it to the expanded position shown in FIG. 2. In the expanded position, upper rib 44 engages lockdown profile upper groove 21. Lower rib 46 engages lockdown profile member lower shoulder 48. Then, the running tool pushes energizing ring 47 downward in the slot between legs 45*a*, 45*b*, permanently deforming legs 45*a*, 45*b* radially into sealing engagement with casing hanger upper exterior portion 31 and wickers 23. Any upward force on casing hanger 25 passes from lockdown shoulder 33 through shoulder ring 41, lockdown ring 37 and lockdown profile member 19 to wellhead housing 11.

The lockdown arrangement shown locks down the casing hanger without a need for an independent lockdown assembly to be installed on top of the casing hanger, which usually involves a separate running trip. The high strength material of the shoulder ring, as well as the lockdown ring and lockdown profile member, avoids the need for making the bodies of the casing hanger and wellhead housing of expensive higher strength material. The flow channels between the shoulder ring and lockdown shoulder reduce the chances for debris to block the radial movement of the lockdown ring as it expands.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

The invention claimed is:

1. A wellhead assembly comprising:

a casing hanger for supporting a string of casing, the casing hanger having an external upward-facing shoulder;

an annular support member on the shoulder, the support member being formed of a material of higher yield strength than a yield strength of the shoulder;

a radially movable annular lockdown member carried on the support member for movement between a retracted position while the casing hanger is being run and an expanded position for engaging an interior surface of a wellhead housing; and a casing hanger seal carried by the casing hanger above the lockdown member, the casing hanger seal having a nose on a lower end that engages and moves the lockdown member to the expanded position while the casing hanger seal is being lowered into a set position.

2. The wellhead assembly according to claim 1, wherein the support member comprises a shoulder ring.

3. The wellhead assembly according to claim 1, further comprising:

flow channels formed in and extending from an inner diameter of the support member to an outer diameter of the support member to assist in removing debris that may collect on the support member.

4. A wellhead assembly comprising:

a casing hanger for supporting a string of casing, the casing hanger having an external upward-facing shoulder;

a shoulder ring mounted on the shoulder;

flow channels between the shoulder and the shoulder ring to assist in flowing debris from above the shoulder to below;

a radially movable annular lockdown member carried on the shoulder ring for movement between a retracted position while the casing hanger is being run and an expanded position for engaging an interior surface of a wellhead housing; and a casing hanger seal carried by the casing hanger above the lockdown member, the casing hanger seal having a nose on a lower end that engages and moves the lockdown member to the expanded position while the casing hanger seal is being lowered into a set position.

5. The wellhead assembly according to claim 4, wherein:

the shoulder ring has a higher yield strength than a body of the casing hanger.

6. The wellhead assembly according to claim 4, wherein:
the shoulder ring has an upper side that is slidingly engaged by a lower side of the lockdown member while the lockdown member moves from the retracted to the expanded position.

7. The wellhead assembly according to claim 4, wherein:
the shoulder ring has an upper side that is within a plane perpendicular to a longitudinal axis of the casing hanger.

8. The wellhead assembly according to claim 4, wherein:
the shoulder on the casing hanger is conical; and
the shoulder ring has a lower side that is conical and mates with the shoulder.

9. The wellhead assembly according to claim 4, wherein:
the shoulder on the casing hanger is conical;
the shoulder ring has a lower side that is conical at a same angle as the shoulder; and
the shoulder ring has an upper side that is flat and located in a plane perpendicular to a longitudinal axis of the casing hanger.

10. The wellhead assembly according to claim 4, further comprising:
flow channels formed in the shoulder ring to assist in flowing debris from above the shoulder to below, the flow channels having inlets on an upper side of the shoulder ring and outlets on a lower side of the shoulder ring, the outlets being radially outward from the inlets relative to a longitudinal axis of the casing hanger.

11. The wellhead assembly according to claim 4, further comprising:
flow channels formed in a lower side of the shoulder ring to assist in flowing debris from above the shoulder to below, the flow channels having inlets on an upper side of the shoulder ring at an inner diameter of the shoulder ring, and outlets on a lower side of the shoulder ring at an outer diameter of the shoulder ring.

12. The wellhead assembly according to claim 4, further comprising:
fasteners extending from an outer diameter of the shoulder ring through the shoulder ring to an inner diameter of the shoulder ring, the fasteners engaging the casing hanger to secure the shoulder ring to the casing hanger.

13. A wellhead assembly comprising:
a wellhead housing having a bore containing an annular lockdown profile;
a casing hanger landed in the wellhead housing for supporting a string of casing, the casing hanger having a longitudinal axis and an external upward and outward facing shoulder that is conical;
a shoulder ring having a conical lower side that mates with and is in contact with the shoulder, the shoulder ring having an upper side that is located in a plane perpendicular to the axis;
a radially movable annular lockdown ring having a lower side in engagement with the upper side of the shoulder ring, the lockdown ring being radially movable between a retracted position while the casing hanger is being run and an expanded position in engagement with the lockdown profile in the wellhead housing; and
a casing hanger seal carried by the casing hanger above the lockdown member, the casing hanger seal having a nose on a lower end that engages and moves the lockdown ring to the expanded position while the casing hanger seal is being lowered into a set position.

14. The wellhead assembly according to claim 13, wherein:
the shoulder ring has a higher yield strength than the shoulder of the casing hanger.

15. The wellhead assembly according to claim 13, further comprising:
flow channels between the shoulder and the shoulder ring to assist in flowing debris from above the shoulder to below.

16. The wellhead assembly according to claim 13, further comprising:
flow channels formed in the shoulder ring to assist in flowing debris from above the shoulder to below, the flow channels having inlets on an upper side of the shoulder ring and outlets on a lower side of the shoulder ring, the outlets being radially outward from the inlets relative to a longitudinal axis of the casing hanger.

17. The wellhead assembly according to claim 13, further comprising:
flow channels formed in a lower side of the shoulder ring to assist in flowing debris from above the shoulder to below, the flow channels having inlets on an upper side of the shoulder ring at an inner diameter of the shoulder ring, and outlets on a lower side of the shoulder ring at an outer diameter of the shoulder ring.

18. The wellhead assembly according to claim 13, further comprising:
fasteners extending from an outer diameter of the shoulder ring through the shoulder ring to an inner diameter of the shoulder ring, the fasteners engaging the casing hanger to secure the shoulder ring to the casing hanger.

19. The wellhead assembly according to claim 13, further comprising:
an annular lockdown profile member mounted within the bore of the wellhead housing, the lockdown profile comprising a lockdown groove in the lockdown profile member; and wherein
the lockdown profile member, the lockdown ring, and the shoulder ring are formed of a material having a greater yield strength than a body of the casing hanger and a body of the wellhead housing.

* * * * *